US009820578B2

(12) United States Patent
Zou et al.

(10) Patent No.: US 9,820,578 B2
(45) Date of Patent: Nov. 21, 2017

(54) POWER LEISURE RECLINING CHAIR

(71) Applicant: Jianhan Zou, Xiamen, Fujian Province (CN)

(72) Inventors: Jianhan Zou, Xiamen (CN); Shihong Zhang, Xiamen (CN); Guohua Chen, Xiamen (CN); Shengyong Li, Xiamen (CN)

(73) Assignee: Jianhan Zou, Xiamen, Fujian Province (CN)

( * ) Notice: Subject to any disclaimer, the term of this patent is extended or adjusted under 35 U.S.C. 154(b) by 236 days.

(21) Appl. No.: 14/933,739

(22) Filed: Nov. 5, 2015

(65) Prior Publication Data

US 2016/0058194 A1 Mar. 3, 2016

Related U.S. Application Data

(63) Continuation of application No. PCT/CN2014/077040, filed on May 8, 2014.

(30) Foreign Application Priority Data

May 9, 2013 (CN) ..... 2013 2 0248385 U

(51) Int. Cl.

| | |
|---|---|
| ***A47C 1/031*** | (2006.01) |
| ***A47C 7/56*** | (2006.01) |
| ***A47C 1/035*** | (2006.01) |
| ***A47C 7/60*** | (2006.01) |
| ***A61H 23/00*** | (2006.01) |
| *A61H 23/02* | (2006.01) |
| *A61H 7/00* | (2006.01) |

(52) U.S. Cl.

CPC ..... *A47C 7/563* (2013.01); *A47C 1/031* (2013.01); *A47C 1/0352* (2013.01); *A47C 7/60* (2013.01);

(Continued)

(58) Field of Classification Search

CPC ..... A47C 7/563; A47C 1/031; A47C 7/60; A47C 1/0352; A61H 23/006

(Continued)

(56) References Cited

U.S. PATENT DOCUMENTS 2,529,451 A * 11/1950 Hoven ..... A47C 7/566 297/322
4,790,599 A * 12/1988 Goldman ..... A47C 1/027 297/282

(Continued)

FOREIGN PATENT DOCUMENTS

CN 101742946 A 6/2010
CN 201840079 U 5/2011

(Continued)

OTHER PUBLICATIONS

State Intellectual Property Office of the P.R. China (ISR/CN), "International Search Report for PCT/CN2014/077040", China, dated Sep. 5, 2014.

*Primary Examiner* — Syed A Islam
(74) *Attorney, Agent, or Firm* — Locke Lord LLP; Tim Tingkang Xia, Esq.

(57) ABSTRACT

A power leisure reclining chair includes a seat structure having a seat portion and a backrest portion, a support assembly having two wooden leg assemblies connected by a wooden cross beam, and a main push rod positioned between the seat structure and the cross beam to push the seat structure to swing. A metal frame and an armrest are arranged on the leg assembly. The support assembly has metal bars extending from a pivot pin on each leg assembly and connecting the seat portion. The metal bar is pivoted to the metal frame. The backrest portion is held at the rear of the leg assemblies by a rail guide system. The rail guide system has guide elements fixed to the leg assembly, and rail member fixed to the backrest portion. The guide element has an under and a top bearing against the bottom and side of the rail member.

10 Claims, 3 Drawing Sheets

(52) U.S. Cl.
CPC ..... *A61H 23/006* (2013.01); *A61H 7/007* (2013.01); *A61H 23/02* (2013.01); *A61H 2201/0149* (2013.01)

(58) Field of Classification Search
USPC ..... 297/325–329, 340–344.15
See application file for complete search history.

(56) References Cited

U.S. PATENT DOCUMENTS 5,967,609 A * 10/1999 Potter ..... A47C 1/027 297/261.3
7,007,965 B2 * 3/2006 Bernatsky ..... A61G 5/1075 280/250.1
8,235,407 B2 * 8/2012 Cerreto ..... A61G 5/1067 280/250.1
8,534,758 B2 * 9/2013 Rivera ..... A47C 1/03294 297/342
9,010,787 B2 * 4/2015 Slagerman ..... A61G 5/1075 280/250.1
9,717,340 B2 * 8/2017 Rivera ..... A47C 1/03294

FOREIGN PATENT DOCUMENTS

CN 202283131 U 6/2012
CN 103027508 A 4/2013
CN 203234980 U 10/2013
EP 0689784 A1 1/1996

* cited by examiner

POWER LEISURE RECLINING CHAIR

CROSS-REFERENCE TO RELATED PATENT APPLICATION

This application is a continuation application of an International Application No. PCT/CN2014/077040, filed May 8, 2014, which itself claims the priority to and benefit of Chinese Patent Application No. 201320248385.4, filed May 9, 2013, which are hereby incorporated herein in their entireties by reference.

FIELD OF THE INVENTION

The present invention relates to a reclining chair, especially to a house ware of a power leisure reclining chair, which provides a user with varies of lie-down poses.

BACKGROUND OF THE INVENTION

A human being is mostly in a normal gravity condition when the position of the heart is higher than the feet, no matter sitting or standing. In this condition, the blood circulation is similarly depending on the gravity. In a massage chair, considering the massage experience, a proposal is to dispose the backrest portion and the seat portion of the massage chair adjustable, so that the feet position can be higher than the heart when the human body keeps curved so that the blood circulation turns to a zero gravity or antigravity condition, so as to obtain a different massage effect. Tests show that it gets a different experience under zero gravity or antigravity condition and thus the human being gets well relax and feels comfortable.

Applied with above technology, there are leisure reclining chairs, for example in Chinese patent database with application number CN201020539131.4, disclosed is a backwardly reclined chair with a negative angle. The backwardly reclined chair is applied with a power push bar to revolve the backwardly reclined chair to a negative angle, so that the head position of the human body is lower than the position of the feet, blood flows to the head, so that the human being feels the head screwed on, and eliminates tiredness in a few minutes. This backwardly reclined chair with a negative angle comprises a seat structure and two leg assemblies, the seat structure comprises a seat portion and a calf stand, the seat portion is movably connected to the calf stand; below the seat structure, a power push bar with a switch button is fixedly attached to the leg assemblies, the head portion of the power push bar is connected to a connection point of seat structure hinge and the leg assemblies stand hinge; two sliding mechanisms are symmetrically disposed inside the chair leg assemblies; each sliding mechanism comprises a support brace fixedly disposed inside the leg assemblies, the bottom of the support brace is disposed with two spaced plane bearing rollers, two spaced concave positioning rollers are disposed above the internal side of the two plane bearing rollers; an arc brace runs through the two concave positioning rollers and the two plane bearing rollers, the rear end of the arc brace is disposed with a positioning block, the arc brace is disposed with several screws to fix to the seat structure. The measure is to disposed an arc rail convex downward below the chair, the arc rail slides between at least two fixed points, so that the whole backrest portion and seat portion slide along the travel of the arc rail to the fixed points, thus realizing a negative angle effect. This measure has obvious disadvantages: as the arc rail and the fixed points bear the whole weight of the chair and the user, it needs high cooperation precision, otherwise, the motion noise is large and the slide is bad due to deformation, burr or damage, resulting in a bad feeling, on the other hand, high cooperation precision calls for high quality of manufacturing of the motion components of the massage chairs, resulting in high costs.

Besides, for some wooden high-end leisure reclining chairs, the power push bar is usually assembled at the cross beam in the front to push the seat structure to slide on the seat frame, this structure of reclining chair needs a seat structure with high bearing stress, if the bearing stress is not even enough, when the power push bar pushes the human body to reposition to a normal sitting pose, a large counterforce on the wooden cross beam is generated thus to make the wooden cross beam broken, resulting in short service life; besides it is unsuitable for heavy users.

SUMMARY OF THE INVENTION

To solve above technical problems, the present invention is provided with a power leisure reclining chair with a wooden support assembly, the present invention can bear heavy and it has a long service life.

The technical proposal of the present invention is:

A power leisure reclining chair, comprising a seat structure, a support assembly and a main push rod, the support assembly has two oppositely-disposed wooden leg assemblies connected by a wooden cross beam, the main push rod is positioned between the seat structure and the cross beam to push the seat structure to swing on the support assembly, the seat structure comprises a seat portion and a backrest portion, wherein, a metal frame and an armrest are arranged on the said leg assembly, the support assembly has metal bars extending from a pivot pin on center portion of each leg assembly and connecting to the seat portion, the backrest portion is held at the rear portion of the leg assemblies by a rail guide system, the metal bar is pivot joint to the metal frame, the rail guide system comprises a pair of rail members and corresponding guide elements adapted for supporting and movably engaging the rail members, the guide element is fixedly attached to the leg assembly, the rail member is fixedly attached to the backrest portion, the guide element comprises a under bearing against the bottom of the rail member and a top bearing against a side portion for inhabiting upward movement of the rail member.

The technical proposal of the present invention is improved with below measures.

Each leg assembly comprises a front stanchion, a rear stanchion and a inclined brace, the lower end of the inclined brace is attached to the center portion of the front stanchion, the armrest is arranged on the inclined brace and the front stanchion, the upper end of the rear stanchion is fixedly attached to the inclined brace for providing stable support for the inclined brace. Each metal frame comprises a reinforcing bar and a support frame, two ends of the reinforcing bar are respectively fixed to the front stanchion and the inclined brace, two ends of the support frame are respectively fixed to the front stanchion and the rear stanchion, the reinforcing bar is fixedly attached to the support frame. Each support frame comprises two downward incline divergent legs, two divergent legs are respectively fixedly attached to the front stanchion and the rear stanchion, the guide element is fixedly attached to the rear divergent leg, the metal bar is movably hinged joint to the center portion of the support frame. A rail member is a bended steel pipe, one end of the rail member is welded to the backrest portion, and the other end of the rail member extending from the backrest portion to the seat portion is welded to the seat portion. The backrest portion comprising a fixed section and a movable section, the movable section is movably hinged joint to the fixed section and is revolvable, a connection of the fixed section and the movable section is further disposed with a pin structure, the pin structure comprises a pin and two pin holes, two pin holes are respectively disposed in the fixed section and the movable section, the pin, when inserts into the pin hole, prevents the movable section from revolving. The under bearing comprises a rubber roller and a bearing support, the bearing support is disposed with a lower fixed shaft, the rubber roller is sleeved on the lower fixed shaft, the bottom of the rail member abuts against the rubber roller. The bearing support is further disposed with an upper fixed shaft, the top bearing is a column and is sleeved on the upper fixed shaft, an external baffle is disposed in the external ends of the upper fixed shaft and the lower fixed shaft, the external baffle is placed at the external side of the rail members. The front portion of the seat structure is disposed with a calf stand to hold calves of a person; a subsidiary push rod is disposed between the calf stand and the seat structure to control the opening angle therebetween. The seat structure is disposed with a vibration massage device.

With above technical proposal, the present invention has following advantages:

As the support assembly to support the seat structure is wooden, and the power push bar is assembled to the wooden cross beam, it makes a very demand to the bearing structure of the support assembly. So that the present invention is disposed with a metal frame in the support assembly, the main push rod is positioned between the seat structure and the cross beam to push the seat structure to swing on the support assembly at the same time, the backrest portion is held at the rear portion of the leg assemblies by a rail guide system. When a user is normally sitting down, the whole weight of the user works on the seat portion, the weight of the user is held by the metal bars, the rail guide system at the rear side bears minor, the seat structure is in a swinging condition, the power push bar can drive the seat structure to slide with a minor force against inertia, the wooden cross beam is acted by a minor counterforce, so that it is uneasily broken. When a user is lying down, the gravity mainly works on the backrest portion of the seat structure, the weight of the user is mainly held by the rail guide system, the metal bars are acted by minor force, so that it is uneasily broken. Therefore, the wooden structure of the present invention not only improves the product level, but also improves the service life and the largest bearing weight by scenically designing the bearing structure.

The leg assemblies of the present invention are applied with a double-cross structure: the upper portion of the inclined brace and the front stanchion form an upper cross to bear the metal bar, the front stanchion, the rear stanchion and the inclined brace form a lower cross to bear the whole weight. This structure is highly stable, since two front stanchions and two rear stanchions are acted by evenly force, so as to enhance the bearing performance of the support assembly.

The present invention is applied with a support measure that the seat structure swings in the center and is supported by a roller at the rear portion, so that the pitch pose of the whole seat structure is more smooth and comfortable. The rear portion is applied with a single point roller to support, thus making it convenient to hide the support structure, so that the product is more beautiful in appearance.

Figure 1:
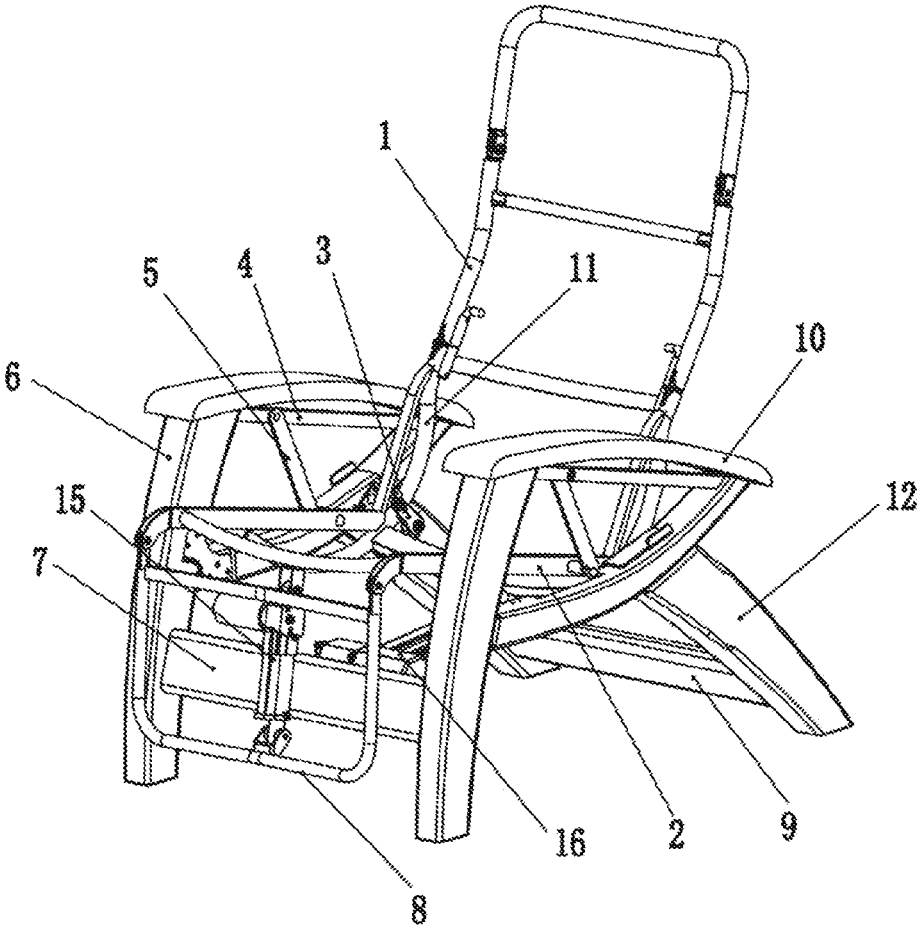
FIG. 1 illustrates a schematic diagram of a whole structure of a first embodiment of the present invention.

Reference signs: backrest portion 1, seat portion 2, guide element 3, bearing support 301, rubber roller 302, lower fixed shaft 303, external baffle 304, upper fixed shaft 305, top bearing 306, reinforcing bar 4, metal bar 5, front stanchion 6, cross beam 7, calf stand 8, support plate 9, armrest 10, rail member 11, rear stanchion 12, inclined brace 13, support frame 14, front divergent leg 141, pin hole 142, rear divergent leg 143, subsidiary push bar 15, main push bar 16.

DETAILED DESCRIPTION OF THE EMBODIMENTS

The First Embodiment

A power leisure reclining chair as shown in FIG. 1, FIG. 2, FIG. 3 and FIG. 4 comprises a seat structure, a support assembly and a main push bar 16, the support assembly has two oppositely-disposed wooden leg assemblies connected by a wooden cross beam 7, the wooden cross beam 7 is disposed at the front portion of the leg assemblies, the main push rod 16 is assembled between the seat structure and the cross beam 7 so as to push the seat structure to slide on the support assembly, a fixed portion of the main push bar 16 is assembled to the wooden cross beam 7, a movable portion of the main push bar 16 is assembled to the seat structure, the movable portion, when moves on the fixed portion, drives the seat structure to slide, in this embodiment, the main push bar 16 is an electric power push bar, but in other cases, it can be applied with pneumatic power push bar. A metal frame and an armrest 10 are arranged on the said leg assembly, the seat structure comprises a seat portion 2 and a backrest portion, the seat portion 2 is used to bear the hip of a user, the backrest portion 1 is for a user to rest with his back and waist, the seat structure is integrally welded. The seat portion 2 swings between the leg assemblies by metal bars 5, so that when a user sits normally, the metal bars 5 bear the main weight, and the weight is evenly distributed on the leg assemblies. The backrest portion 1 is held at the rear portion of the leg assemblies, when a user is lying down, the rail guide system bears the main weight, the rear portions of the leg assemblies are the main bearing portion. each metal bar 5 is movably hinged to the metal frame, the rail guide system comprises a guide element 3 and a rail member 11, the guide element 3 is fixed to the leg assemblies, the rail member 11 is fixed to the backrest portion 1, the guide element 3 comprises an under bearing against the bottom of the rail member 11 and a top bearing 306 against a side portion for inhabiting upward movement of the rail member 11.

Figure 4:
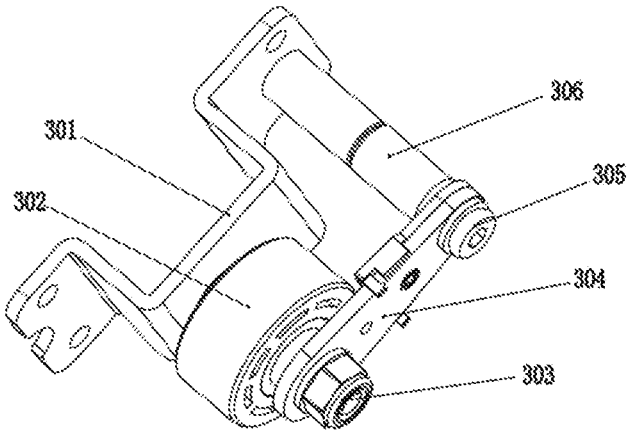
FIG. 4 illustrates a schematic diagram of a guide element of the first embodiment of the present invention.

As figured in FIG. 4, the under bearing comprise a rubber roller 302 and a bearing support 301, the bearing support 301 is fixed to said leg assembly, the bearing support 301 is disposed with a lower fixed shaft 303, the rubber roller 302 is sleeved on the lower fixed shaft 303 and is rotatable on the lower fixed shaft 303, the bottom of the rail member 11 abuts against the rubber roller 302, when the main push bar 16 pushes the seat structure to slide on the support assembly, the rail member 11 slides on the rubber roller 302 as well, this structure highly induces slide resistance of the rail member 11. the bearing support 301 is further disposed with an upper fixed shaft 305, the top bearing 306 is a column and is sleeved on the upper fixed shaft 305, for inhabiting upwardly movement of the rail member 11, the top bearing 306 is made from rigid and wear resistant nylon material, an external baffle 304 is disposed at the external ends of the upper fixed shaft 305 and the lower fixed shaft 303, the external baffle 304 is placed at the external side of the rail member 11 to prevent the rail member 11 from flying away.

Figure 3:
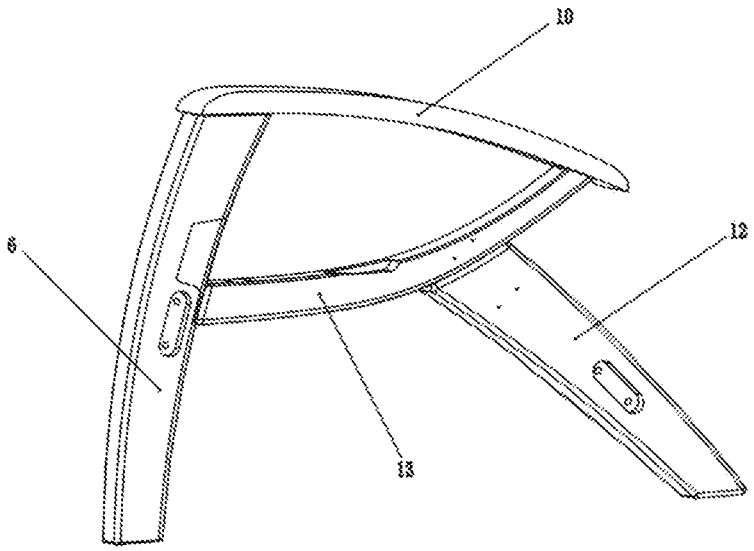
FIG. 3 illustrates a schematic diagram of a leg assembly of the first embodiment of the present invention.

As figured in FIG. 3, each leg assembly comprises a front stanchion 6, a rear stanchion 12 and an inclined brace 13, the lower portion of the inclined brace 13 is fixedly attached to a waist of the front stanchion 6, the armrest 10 is disposed on the inclined brace 13 and the front stanchion 6, the upper portion of the rear stanchion 12 is connected to the inclined brace 13 to support the inclined brace 13. The wooden cross beam 7 is fixed to the two front stanchions 6, a support plate 9 is bridge joint between the two rear stanchions 12, and the support plate 9 is a wooden plate. The front stanchion 6, the rear stanchion 12 and the inclined brace 13 form a stable support frame structure, the upper portion thereof is used to resolute the force of the metal bars 5 to the leg assemblies, the lower portion thereof is stably supporting the whole seat structure. Each metal frame comprises a reinforcing bar 4, two ends of which are respectively fixed to the front stanchion 6 and the inclined brace 14, each metal bar 5 is movably hinged at the center of the reinforcing bar 4 so as to prevent the seat structure from sliding under the work of a impact force when a user sits down, at initial state, the metal bars 5 swings to the back side in a certain angle, so that the centric position of the seat structure moves backwards to resist impact when a user sits down. The connection of the rear stanchion 12 and the inclined brace 13 is disposed with connection metal plate to reinforce the connection intensity therebetween; the guide element 3 is fixedly attached to the metal plate.

Figure 2:
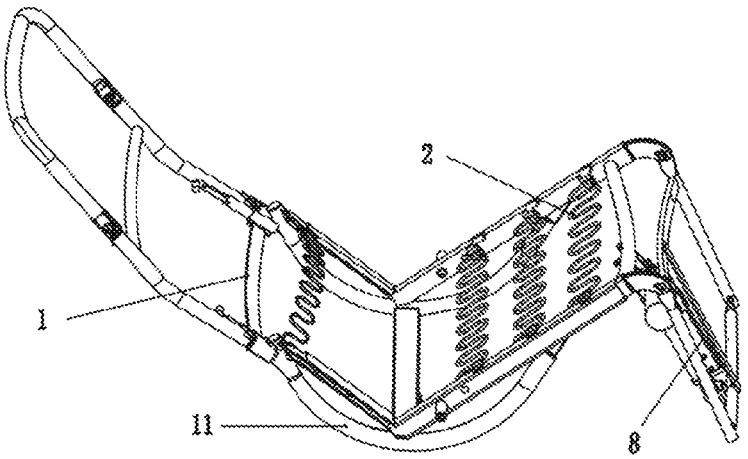
FIG. 2 illustrates a schematic diagram of a seat structure of the first embodiment of the present invention.

As figured in FIG. 2, the rail member 11 is made of bended steel pipe, one end of the rail member 11 is welded to the backrest portion 1, the other end of the rail member 11 extending from the backrest portion to the seat portion 2 is welded to the seat portion, so as to enhance the connection intensity of the backrest portion 1 and the seat portion 2. The rail member 11 has at least three welding points to the seat structure: a welding point at backrest portion, a welding point at the connection and a welding point at the seat portion. The guide element 3 can only slide between the welding point at the backrest portion and the welding point at the connection. The backrest portion 1 comprises a fixed section and a movable section, the movable section is movably hinged joint to the fixed section and is revolvable, the connection of the fixed section and the movable section is further disposed with a pin structure, the pin structure comprises a pin and two pin holes, two pin holes are respectively disposed in the fixed section and the movable section, a pin, when inserts into the pin hole, prevents the movable section from revolving. During wrapping and transporting, to reduce the height of the seat structure, pulling the pin out of the pin hole, revolving the movable section to fold the seat structure, to use the reclining chair, inserting the pin to the pin hole to prevent the movable section from revolving. The front end of the seat structure is disposed with a calf stand 8 for the calves of a person to place; a subsidiary push rod 15 is disposed between the calf stand 8 and the seat structure to control the opening angle therebetween. the seat structure is disposed with a vibration massage device, which is made from a vibratory motor wrapped with soft material, the motor vibrates to work on the human being in a massage way. In other embodiments, kneading or knocking massage devices can be used in the present invention.

The Second Embodiment

Figure 5:
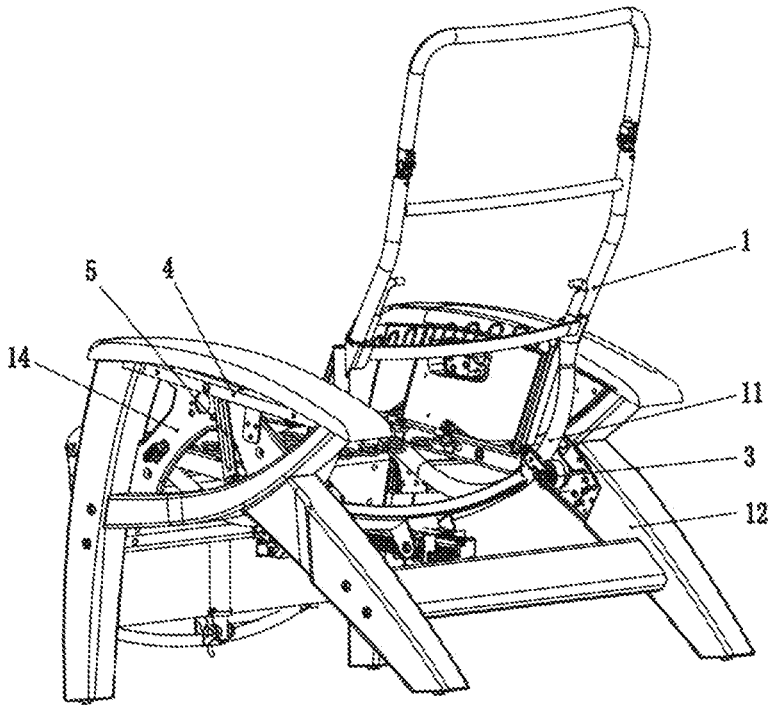
FIG. 5 illustrates a schematic diagram of a whole structure of a second embodiment of the present invention.
Figure 6:
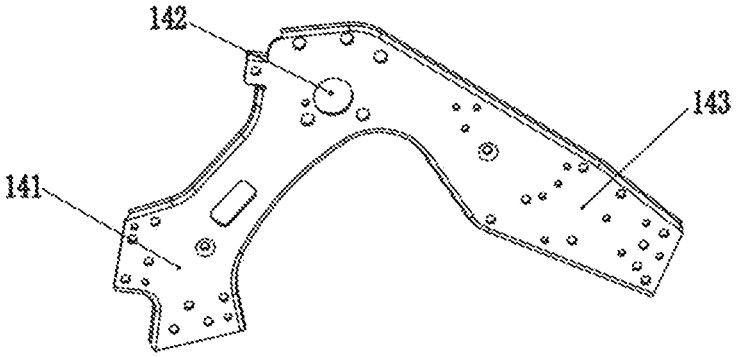
FIG. 6 illustrates a schematic diagram of a metal frame of the second embodiment of the present invention.

As shown in FIG. 5 and FIG. 6, the basic structure of this embodiment is similar to the first embodiment, the difference is in that, each metal frame further comprises a support frame 14, the center of the reinforcing bar 4 is fixed to the support frame 14. Each armrest 10 is fixed to the support frame 14 by a metal connection element, the support frame 14 comprises two inclined divergent legs extending downward, they are a front divergent leg 14 and a rear divergent leg 143, two divergent legs are respectively fixedly attached to the front stanchion 6 and the rear stanchion 12, the bearing support is fixed to the rear divergent leg 143, the center of the support frame 14 and the reinforcing bar 4 is fixed with a rotation shaft, the metal bar 5 is movably hinged to the rotation shaft, the reinforcing bar 4 and the support frame 14 are respectively disposed with corresponding a rotation hole 142. The support frame 14 connects the armrest 10, the front stanchion 6, the rear stanchion 12 and the inclined brace 13 to enhance the support intensity of the leg assemblies.

The work principle of the present invention is that: when a user is normally sitting on the chair, the whole weight of the user works on the seat portion, the weight of the seat structure and the user transfers to the support assembly through the metal bars, the metal bars are disposed respectively at the center of corresponding leg assemblies, so that the leg assemblies have evenly force, as the seat structure is in a swinging condition, the electric push bar only needs small force to push the seat structure to slide, so that it prevents an accident that when in initial position, the wooden cross beam may be broken under the impact of the inertial force of the seat structure from standing still to motion when pushed. When user is lying down, the weight of the user works on the backrest portion, the metal bars are in their most inclined state, so that the stress is minor, the weight of the seat structure and the user are transferred to the support assembly through the guide element, the seat structure is basically supported at a single point, as with the rubber roller, the friction therebetween is minor, the electric push bar can push the seat structure to slide and reposition with a small force, so that it prevents a situation that, when in rest position, the wooden cross beam may be broken under the impact of the inertial force of the seat structure from standing still to motion when pushed. The present invention is disposed with different support structures in different positions, and combines hanging support and a single point roller support, which effectively enhance the structure strength of the wooden reclining chair.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention relates to a power leisure reclining chair, which is applied with a support measure that the seat structure swings in the center and is supported by a roller at the rear portion, so that the pitch pose of the whole seat structure is more smooth and comfortable. The rear portion is applied with a single point roller to support, thus making it convenient to hide the support structure, so that the product is more beautiful in appearance.

What is claimed is:

1. A power leisure reclining chair, comprising a seat structure, a support assembly and a main push rod, the support assembly has two oppositely-disposed wooden leg assemblies connected by a wooden cross beam, the main push rod is positioned between the seat structure and the cross beam to push the seat structure to swing on the support assembly, the seat structure comprises a seat portion and a backrest portion, wherein, a metal frame and an armrest are arranged on the said leg assemblies, the support assembly has metal bars connecting the seat portion to a pivot pin in the center portion of each leg assembly, the backrest portion is held at the rear portion of the leg assemblies by a rail guide system, the metal bar is pivot joint to the metal frame, the rail guide system comprises a pair of rail members and corresponding guide elements adapted for supporting and movably engaging the rail members, the guide element is fixedly attached to the leg assembly, the rail member is fixedly attached to the backrest portion, the guide element comprises a under bearing against the bottom of the rail member and a top bearing against a side portion for inhabiting upward movement of the rail member.

2. The power leisure reclining chair according to claim 1, wherein each leg assembly comprises a front stanchion, a rear stanchion and a inclined brace, the lower end of the inclined brace is attached to the center portion of the front stanchion, the armrest is arranged on the inclined brace and the front stanchion, the upper end of the rear stanchion is fixedly attached to the inclined brace for providing stable support for the inclined brace.

3. The power leisure reclining chair according to claim 2, wherein each metal frame comprises a reinforcing bar and a support frame, the two ends of the reinforcing bar are respectively fixed to the front stanchion and the inclined brace, the two ends of the support frame are respectively fixed to the front stanchion and the rear stanchion, the reinforcing bar is fixedly attached to the support frame.

4. The power leisure reclining chair according to claim 3, wherein each support frame comprises two downward incline divergent legs, the two divergent legs are respectively fixedly attached to the front stanchion and the rear stanchion, the guide element is fixedly attached to the rear divergent leg, the metal bar is movably hinged joint to the center portion of the support frame.

5. The power leisure reclining chair according to claim 1, wherein a rail member is a bended steel pipe, one end of the rail member is welded to the backrest portion, the other end of the rail member extending from the backrest portion to the seat portion is welded to the seat portion.

6. The power leisure reclining chair according to claim 1, wherein the backrest portion comprising a fixed section and a movable section, the movable section is movably hinged joint to the fixed section and is revolvable, a connection of the fixed section and the movable section is further disposed with a pin structure, the pin structure comprises a pin and two pin holes, the two pin holes are respectively disposed in the fixed section and the movable section, the pin, when inserts into the pin hole, prevents the movable section from revolving.

7. The power leisure reclining chair according to claim 1, wherein the under bearing comprises a rubber roller and a bearing support, the bearing support is disposed with a lower fixed shaft, the rubber roller is sleeved on the lower fixed shaft, the bottom of the rail member abuts against the rubber roller.

8. The power leisure reclining chair according to claim 7, wherein the bearing support is further disposed with an upper fixed shaft, the top bearing is a column and is sleeved on the upper fixed shaft, an external baffle is disposed in the external ends of the upper fixed shaft and the lower fixed shaft, the external baffle is placed at the external side of the rail members.

9. The power leisure reclining chair according to claim 1, wherein the front portion of the seat structure is disposed with a calf stand to hold calves of a person, a subsidiary push rod is disposed between the calf stand and the seat structure to control the opening angle therebetween.

10. The power leisure reclining chair according to claim 1, wherein the seat structure is disposed with a vibration massage device.

* * * * *